United States Patent [19]

Erhardt et al.

[11] Patent Number: 4,863,100

[45] Date of Patent: Sep. 5, 1989

[54] ELECTRONIC FLOW CONTROLLER FOR HYDRONIC HEATING SYSTEMS

[76] Inventors: James A. Erhardt, P.O. Box 1404, Patchogue, N.Y. 11772; Bruce E. Richardson, 60 Artist Lk. Dr., Middle Island, N.Y. 11953

[21] Appl. No.: 117,080

[22] Filed: Apr. 4, 1988

[51] Int. Cl.[4] ..... F24D 3/00

[52] U.S. Cl. ..... 237/8 R; 236/46 R

[58] Field of Search ..... 237/8 R, 56; 236/9 A, 236/20 R, 91 F, 46 F

*Primary Examiner*—Henry A. Bennet

[57] ABSTRACT

This invention relates to an electronic flow control circuit for use in the low voltage section of an existing control arrangement of a hydronic heating system that utilizes motorized zone valves, to provide a means for controlling fluid flow through the system in order to eliminate hydrostatic shock (water hammer) associated with fast closing motorized zone valves.

5 Claims, 2 Drawing Sheets

ELECTRONIC FLOW CONTROLLER FOR HYDRONIC HEATING SYSTEMS

This invention relates to an electronic flow control circuit for use in hydronic heating systems with motorized zone valves. An object of the invention is to provide a means of eliminating hydrostatic shock (water hammer) that occurs with fast closing motorized zone valves. Another object of the invention is that the means for elimination of hydrostatic shock be inexpensive to produce and easy to install into a variety of control arrangements commonly used in conjunction with motorized zone valves.

BACKROUND OF INVENTION

Motorized zone valves used in conjunction with a single circulating pump (circulator) are a popular and modern method of zone control in hydronic heating systems. Motorized zone valves of various manufacture will vary in closing time, and those which close too quickly may cause hydrostatic in the system piping.

One of the most commonly used motorized zone valves is comprised of a synchronous motor connected to and operating a fluid handling valve assembly. The synchronous motor is powered through a 24 volt circuit that is controlled by a temperature activated switch (thermostat). Upon a call for heat in a given zone, the thermostat closes and energizes the synchronous motor in the zone valve. As the zone valve reaches its full open position, an integral end switch in the zone valve is tripped into a closed position. The closed end switch then energizes a circulator relay, which results in heat transfer fluid flowing through the system. This provides space heating for that zone. As the temperature requirements for that zone becomes satisfied, the thermostat falls back to an open position. At that instant the zone valve becomes de-energized and its end switch opens as it closes by spring action. If no other zone valves remain energized, the circulator de-energizes the moment the end switch opens.

The conditions needed to produce water hammer are present when a plurality of zone valves are energized, then one of them becomes de-energized due to satisfied space heating requirements for that zone. As the de-energized zone valve closes by spring action, the circulator continues to run due to the closed end switch(es) in the still energized zone valve(s). If the zone valve closes too quickly, the fluid flow in that zone comes to a sudden stop. When this occurs, a momentary low pressure area forms closely down stream of the closed zone valve in the heat distribution piping. As the fluid rebounds into this area seeking equilibrium, hydrostatic shock occurs. If the shock is of large enough magnitude, it will be heard as water hammer in the system piping by the occupants of the building.

No certain method existed in the past to eliminate water hammer associated with fast closing motorized zone valves. All past procedures for solving the problem involved trial and error methods which were slow and uncertain. The only remaining alternative of changing zone valves to those of another manufacture or replacing the zone valves with individual circulators and relays involves a greater amount of time and capital resources.

SUMMARY

According to one embodiment of the invention, the electronic flow control circuit is wired into the low voltage section of an existing control arrangement for a hydronic heating system that utilizes motorized zone valves. When a plurality of zone valves are open, and then one of them closes, the control circuit de-energizes the circulator simultaneously with the opening of the zone valves end switch. After a timed interuption of long enough duration to ensure the zone valve has fully closed, circulator function is restored. The control provides an easy and economical solution to the problem of water hammer associated with fast closing motorized zone valves.

PREFERRED EMBODIMENTS

Figure 1:
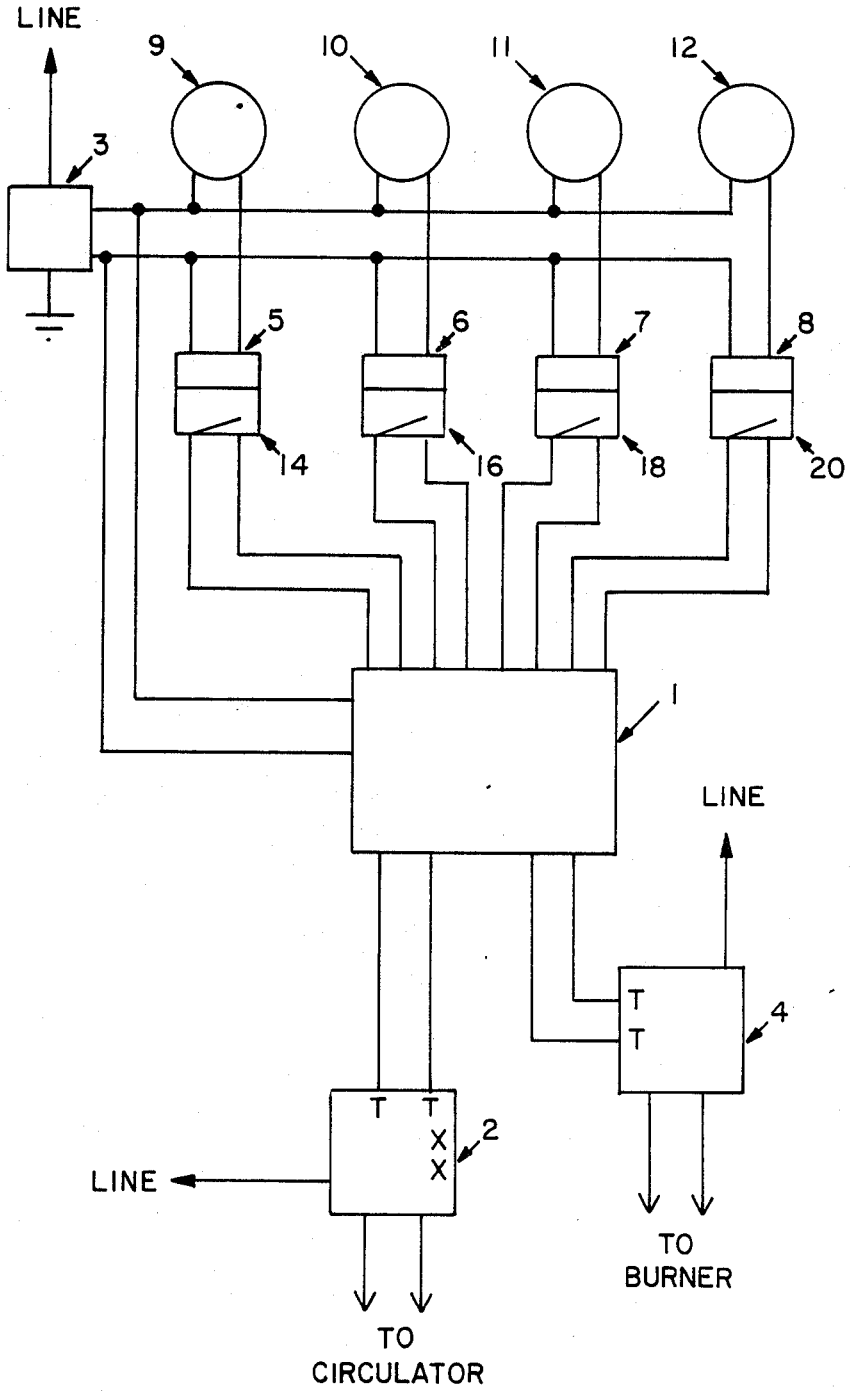
FIG. 1 shows the intergration of the invention into a control arrangement commonly used in conjunction with motorized zone valves.

Referring to FIG. 1, the electronic flow control circuit 1 is wired into the low voltage section of an existing control arrangement, comprised of thermostats 9,10,11 and 12, power supply transformer 3, zone valves 5,6,7 and 8,with their individual end switches 14,16,18 and 20, circulator relay 2 and burner relay 4. Leads from end switches 14,16,18 and 20 were formerly connected directly to the (TT) terminals on circulator relay 2, and input leads to burner relay 4 were connected to auxillary terminals (XX) on circulator relay 2. The control circuit is powered by transformer 3.

Figure 2:
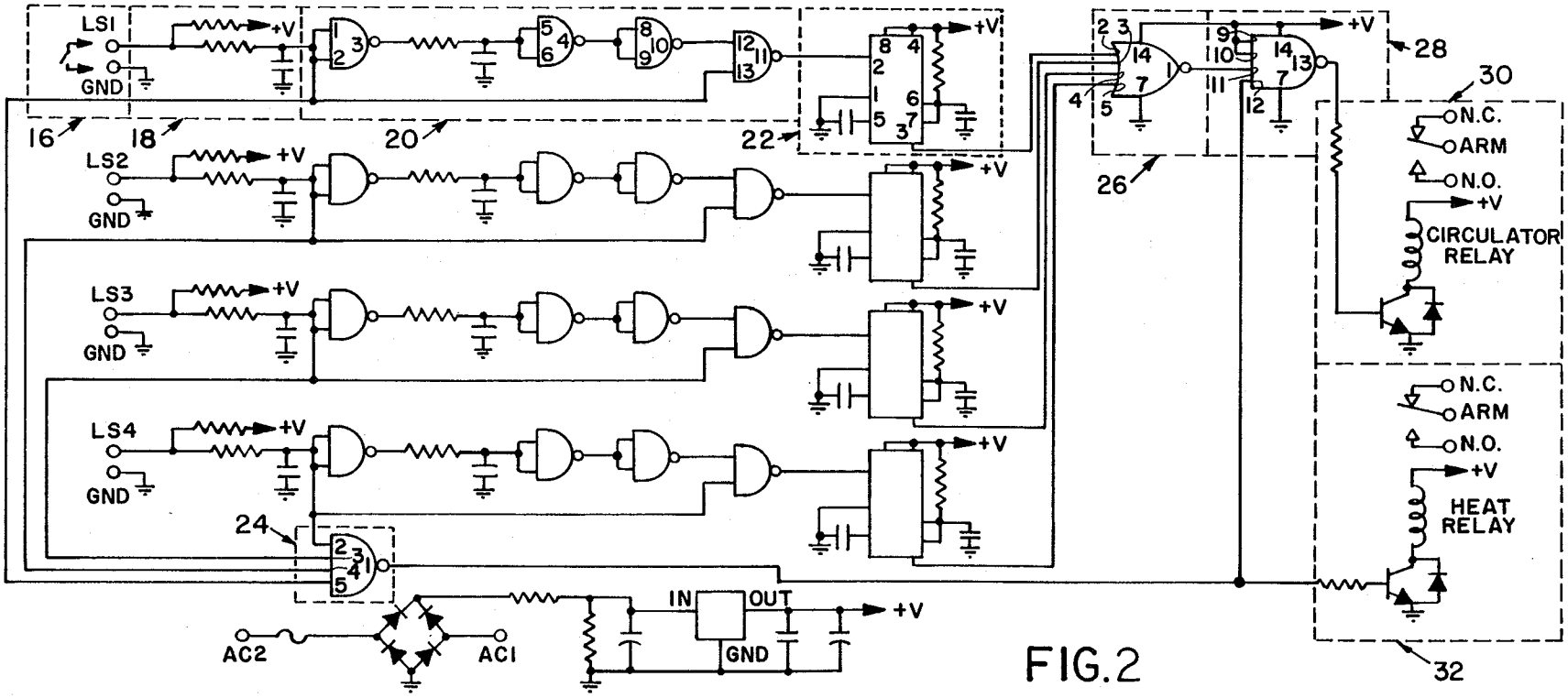
FIG. 2 shows a detailed schematic of an example flow control circuit that would fulfill the objects of the invention.

Referring to FIG. 2, a schematic of an example circuit is shown. Individual input sections are comprised of R-C switch debounce networks 18, negative edge detector circuits 20, and timing circuits 22. Outputs of R-C switch debounce networks 18 feed the inputs of the primary NAND logic gate 24, which in turn supplies the signal for an input on the secondary NAND logic gate 28. Output from primary NAND logic gate 24 also controls burner relay circuit 32, whose output terminals are normally open. Outputs from timing circuits 22 supply input signals to NOR logic gate 26, which in turn supplies signal to the other input of secondary NAND logic gate 28. Circulator relay circuit 30, whose output terminals are normally open, is controlled by secondary NAND logic gate 28. If one or more of end switches 16 become closed, the primary NAND logic 24, through the functions of secondary NAND logic gate 28, will close the output terminals of circulator relay 30. If a plurality of end switches 16 are closed, and then one of them opens, negative edge detector circuit 20 triggers timing circuit 22, which through the functions of NOR logic gate 26 and secondary NAND logic gate 28, simultaneously opens the output terminals of circulator relay 30. When all timing circuits 22 are satisfied, and if an end switch 16 remains closed, the output terminals of circulator relay 30 recloses through the functions of primary NAND logic gate 24, NOR logic gate 26 and secondary NAND logic gate 28. Adjustment of duration of circulator interruption is achieved when a plurality of timing circuits 22 are triggered in succession, the output of NOR logic gate 26 is controlled by the output of the last timing circuit 22 triggered. When all end switches 16 return to an open position, the output terminals of circulator relay circuit 30 and burner relay circuit 32 return to an open position.

Modifications of the above described flow control circuit may occur to a person skilled in the art. Therefore, the above description is to be considered as illustrative and not in a limiting sense.

We claim:

1. An electronic flow contorl circuit for hydronic heating systems which comprises;

(a) means for detecting the opening and closing of a plurality of zone valves;

(b) means for temporarily interrupting circulator function when any of said plurality of zone valves begins to close;

(c) means for timing and adjusting duration of circulator interruption;

(d) means for restoring circulator function "after a timed period of interruption," if any of said plurality of zone valves remain open.

2. The electronic flow control circuit of claim 1, which is comprised of a means fôr controlling a burner relay uninterrupted with the opening and closing of said plurality of zone valves.

3. The electronic flow control circuit of claim 2, in which the means for detecting the opening and closing of said plurality of zone valves comprises;

(a) R-C switch debounce networks;

(b) negative edge detector circuits, which are connected to the outputs of said R-C switch debounce networks.

4. The electronic flow control circuit of claim 3, in which the means for the functions of claim 1b,1c and 1d comprises;

(a) R-C timing circuits, triggered by the output signals of said negative edge detector circuits;

(b) NOR logic gate, which is controlled by the output signals of said R-C timing circuits;

(c) primary NAND logic gate, which is controlled through said R-C switch debounce networks;

(d) secondary NAND logic gate, which is controlled by the output signals of said NOR and primary NAND logic gates;

(e) a circulator relay circuit, which is controlled by said second NAND logic gate.

5. The electronic flow control circuit of claim 4, in which the means for controlling a burner relay uninterrupted comprises a burner relay circuit, controlled by the output signal of said primary NAND logic gate.

* * * * *